US006243877B1

(12) United States Patent
Heyward, Jr.

(10) Patent No.: US 6,243,877 B1
(45) Date of Patent: Jun. 12, 2001

(54) DISPLAY HAT

(76) Inventor: Mike Heyward, Jr., 722 Hitching Post Rd., Charleston, SC (US) 29414

( * ) Notice: Subject to any disclaimer, the term of this patent is extended or adjusted under 35 U.S.C. 154(b) by 0 days.

(21) Appl. No.: 09/502,135

(22) Filed: Feb. 11, 2000

Related U.S. Application Data

(60) Provisional application No. 60/119,676, filed on Feb. 11, 1999.

(51) Int. Cl.[7] ..... A42B 1/00

(52) U.S. Cl. ..... 2/195.1

(58) Field of Search ..... 2/171, 209.12, 2/209.13, 175.1, 195.1, 195.2, 200.1, 200.3, 918

(56) References Cited

U.S. PATENT DOCUMENTS 2,803,829 * 8/1957 Tscharner ..... 2/171.1
5,091,994 * 3/1992 Delane et al. ..... 2/195
5,091,995 * 3/1992 Oates ..... 2/195

* cited by examiner

*Primary Examiner*—John J. Calvert
*Assistant Examiner*—Katherine Moran
(74) *Attorney, Agent, or Firm*—B. Craig Killough

(57) ABSTRACT

A baseball cap having multiple bills and placards, with each bill associated with one placard. The bills and placards are spaced apart in an equidistant manner. Each bill is connected to a placard, which is termed herein as its associated placard. Each placard is adjacent to, and beside, another of the placards. A minimum of three placards and corresponding bills, and a maximum of five placards, and corresponding bills, is used, with each placard having a different message, logo or design appearing thereon. A design, logo, message or other indicia may also appear on one or more of the bills.

3 Claims, 1 Drawing Sheet

DISPLAY HAT

Figure 1:
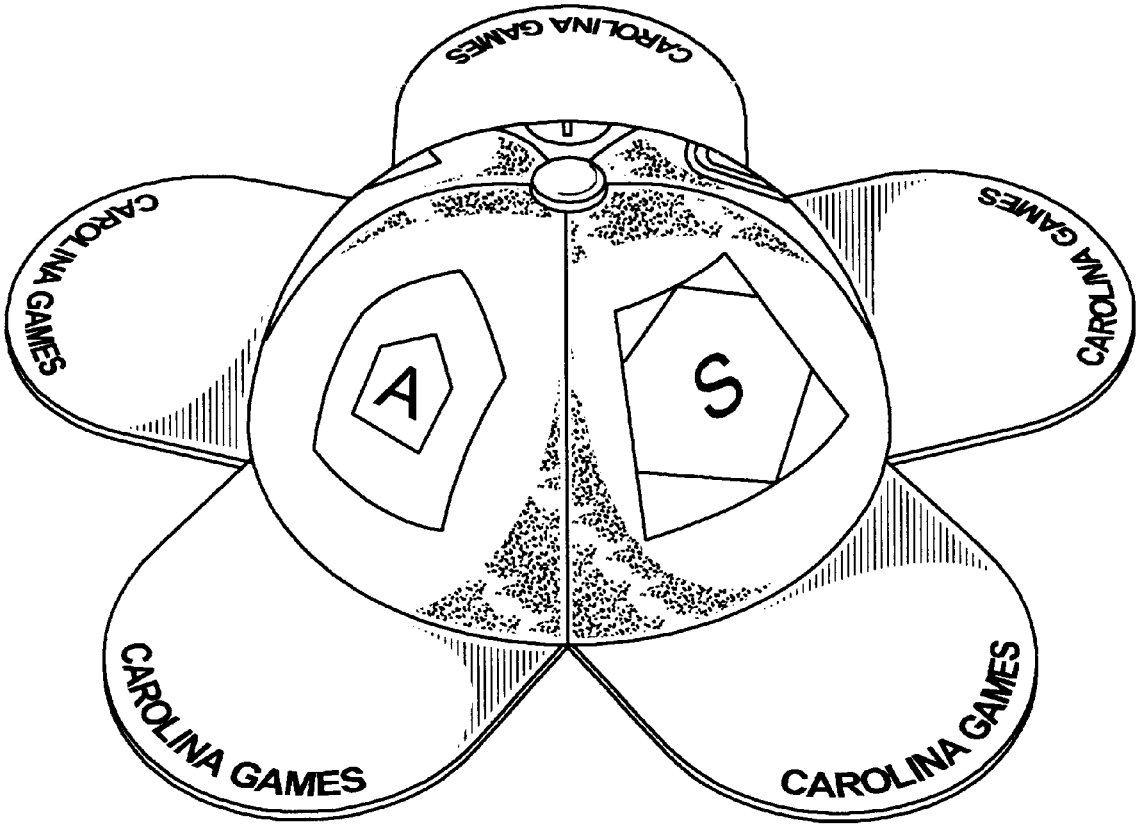

This application claims priority of provisional application Ser. No. 60/119,676, filed Feb. 11, 1999.

FIELD OF THE INVENTION

This invention relates generally to advertising or promotional display devices, and is more particularly directed to a hat which displays multiple advertising or promotional messages, logos or indicia.

BACKGROUND OF THE INVENTION

Advertising and promotional items in the form of clothing are in common use. T-shirts having team logos, or commercial advertising messages, or other indicia, are commonly available.

Similarly, baseball caps having team logos or advertising messages are in common use. Baseball caps are hats having a single bill on one side of the cap. The bill is a generally horizontal plane which protrudes over the wearers face, although, from time to time, baseball caps are worn in a backwards or sideways fashion, so that the single bill extends to the side or back. In any event, a single bill which extends from about one quarter of the circumference of the cap characterizes baseball caps in common use.

Baseball caps also have a generally vertical placard which is adjacent to the bill, and on which a team logo, or alternatively, an advertising display or similar indicia may be located. However, baseball caps in the prior art have only one of such placards. This placard is located over the single bill, since caps in use have only one bill.

SUMMARY OF THE PRESENT INVENTION

The present invention is a baseball cap having not less than three bills, and as many as five bills. Each bill has a placard associated therewith. Multiple team logos may be placed on the cap through the use of multiple placards. For example, if a particular city has three major league sports teams, such as football, baseball and basketball, the team logo for each team can appear on a single baseball style hat. The placard and associated bill can be formed in the appropriate team colors, with the adjacent placard and bill formed in different, but appropriate, colors to the logo. Additionally, or as an alternative, advertising messages and logos, and other designs or indicia can appear on the placards.

DESCRIPTION OF THE DRAWING FIGURES

FIG. 1 is a perspective view of the display hat having five placards and five bills.

DESCRIPTION OF THE PREFERRED EMBODIMENT

Referring now to the drawing FIGURE, a baseball hat having five bills and five placards is shown, with each bill associated with one placard. The bills and placards are spaced apart in an equidistant manner. Each bill is connected to a placard, which is termed herein as its associated placard. Each placard is adjacent to, and beside, another of the placards.

A team logo appears upon each of the placards. The display on each of the placards is different. If a city has a major league football, baseball, basketball, hockey and soccer team, a logo from each could appear upon the placards. Alternatively, four sports logos could appear, along with one advertising logo, to occupy the five bills. In any event, a minimum of three placards and corresponding bills, and a maximum of five placards, and corresponding bills, is used, with each placard having a different message, logo or design appearing thereon. A design, logo, message or other indicia may also appear on one or more of the bills.

In use, if the wearer attends a football game, then the logo of the football team is worn above the face, with the remaining team logos or other messages appearing on the placards around the remaining circumference of the hat. If the wearer attends a basketball game, then the logo of the basketball team appears over the face of the wearer, with the remaining logos or designs otherwise appearing on the hat. In this manner, a single hat serves the fan of multiple sports teams.

The hat may be personalized or customized through, for example, digital printing technology, so that if the fan pulls for teams in different cities, the hat may be customized as desired. As a promotional item, one or more placards may have the promotional sponsor's logo appearing thereon, and the remaining placards may be customized according to the wearers desires.

What is claimed is:

1. A display hat having multiple bills and multiple designs thereon, said display hat comprising five bills and five placards, with each of said placards extending upwardly from one of said bills, and each of said placards having a first side and a second side, with said first side adjoining a second side of another of said placards and said second side adjoining a first side of another of said placards.

2. A display hat having multiple bills and multiple designs as described in claim 1, wherein said bills are spaced apart equidistant from each other.

3. A display hat having multiple bills and multiple designs as described in claim 1, wherein each of said placards has a design appearing thereon which is different from a design appearing on another of said placards.

* * * * *